US006182640B1

(12) United States Patent
Nakashima et al.

(10) Patent No.: US 6,182,640 B1
(45) Date of Patent: Feb. 6, 2001

(54) FUEL SUPPLY UNIT FOR VEHICLE

(75) Inventors: Tai Nakashima; Masayuki Dazai; Nobuo Ono; Hiroto Yoshiki, all of Saitama (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/158,831

(22) Filed: Sep. 23, 1998

(30) Foreign Application Priority Data

Sep. 23, 1997 (JP) ..... 9-276405

(51) Int. Cl.[7] ..... F02M 37/04
(52) U.S. Cl. ..... 123/516; 123/514
(58) Field of Search ..... 123/516, 514, 123/509, 510; 137/568, 571, 576–579, 585

(56) References Cited

U.S. PATENT DOCUMENTS 4,279,332 * 7/1981 Schuster ..... 123/516
4,767,632 * 8/1988 Andreasson ..... 123/514
4,974,570 * 12/1990 Szwargulski ..... 123/514
5,427,074 * 6/1995 Tuckey ..... 123/516
5,560,342 * 10/1996 Fournier ..... 123/516
5,579,740 * 12/1996 Cotton ..... 123/516
5,797,376 8/1998 Frank et al. .
5,797,378 * 8/1998 Kato ..... 123/516
5,894,857 * 4/1999 Takaki ..... 123/516

FOREIGN PATENT DOCUMENTS

0743445 A1 11/1996 (EP) .
63-227949 9/1988 (JP) .

* cited by examiner

*Primary Examiner*—Carl S. Miller
(74) *Attorney, Agent, or Firm*—Birch, Stewart, Kolasch & Birch, LLP

(57) ABSTRACT

A fuel supply unit for a vehicle includes a fuel tank, a fuel pump for providing a fuel supply system of the vehicle with fuel introduced from the fuel tank via a strainer disposed therein, a fuel return pipe for returning surplus fuel from the fuel supply system to the fuel tank and a spongy fuel-adsorbing member disposed between the strainer end a tip of the fuel return pipe.

20 Claims, 6 Drawing Sheets

FUEL SUPPLY UNIT FOR VEHICLE

BACKGROUND OF THE INVENTION

1. Field of the Invention

This invention relates to a fuel supply unit for supplying fuel to a fuel supply system of an engine from a fuel tank mounted on a vehicle such as a motorcycle.

2. Description of Background Art

Japanese Patent Laid-Open Publication No. Sho. 63-227949 discloses a fuel supply unit for a vehicle, in which a fuel tank houses a subsidiary tank, which encloses a fuel pump. A fuel return pipe communicates with the fuel pump via an open end thereof. FIG. 6 schematically illustrates the configuration of a fuel supply unit including an in-tank type fuel pump that is applied to a motorcycle.

Referring to FIG. 6, a fuel pump 2 is housed in a fuel tank 1 at a rear bottom thereof, and is connected at its inlet port 3 to a strainer 4 having a resin mesh filter for removing foreign matter. A discharge pipe extends from a discharge port of the fuel pump 2 for introducing fuel to a throttle body 7 outside the fuel tank 1 via a high pressure fuel filter 6. The fuel is then injected by fuel injectors into combustion chambers of the engine. Part of the fuel is returned as surplus fuel to an area near the strainer 4 by a pressure regulator 9 of the throttle body 7 via a connecting hose 10*a* and a fuel return pipe 10.

In the foregoing related art, the fuel returned via the fuel return pipe contains a lot of gases. The fuel pump draws up such returned fuel when the fuel in either the fuel tank or the subsidiary tank is nearly reduced to a lower limit. Therefore, the engine sometimes suffers from a surge. In such a case, the mesh filter in the strainer does not contribute to separation of gases from the fuel.

When accelerating, decelerating or turning, a motorcycle changes its posture extensively compared with a four-wheel vehicle. In such a case, the motorcycle engine tends to suffer from surge because the level of the fuel varies in the fuel tank. There has been a strong demand for preventing the surge caused by the foregoing reasons.

SUMMARY AND OBJECTS OF THE INVENTION

In order to overcome the foregoing problems, the invention provides a fuel supply unit according to a first aspect, which comprises: a fuel tank; a fuel pump for providing a fuel supply system of a vehicle with fuel introduced from the fuel tank via a strainer disposed therein; a fuel return pipe for returning surplus fuel from the fuel supply system to said fuel tank; and a spongy fuel-adsorbing member disposed between the strainer and a tip of the fuel return pipe.

The fuel-adsorbing member is made of a spongy material which is full of minute pores and is elastic and flexible, can attract fuel thereonto, and can separate gases from the returned fuel. The fuel-adsorbing member may be constructed of a natural material, a foamed synthetic resin material, or a metallic material. For example, it may be made of a corrosion-resistant metal. In the specification, the terms "forward direction" and "rear direction" represent the directions in which the vehicle is operated, and "upward direction" and "downward direction" represent the directions with respect to a standing position of the vehicle.

In the fuel supply unit according to a second aspect, the partition is disposed in the fuel tank in order to separate at least an area near the inlet port of the fuel pump and the area in front of the inlet port. The fuel-adsorbing member is supported by the partition.

According to a third aspect of the invention, the fuel supply unit is designed for a motorcycle.

According to the first aspect, the spongy fuel-adsorbing member is disposed between the strainer and the tip of the fuel return pipe, thereby enabling the air-fuel mixture returned via the fuel return pipe to be separated into gases and liquid fuel. The liquid fuel is adsorbed onto the fuel-adsorbing member and usually stays near the strainer. Even when the amount of fuel is reduced nearly to the lower limit, it is possible to supply the foregoing liquid fuel to the fuel tank from the adsorbing member, so that the engine can be protected against a surge. Further, the liquid fuel adsorbed onto the fuel-adsorbing member remains around the strainer, which allows the fuel to be supplied substantially without being affected by the varying posture of the vehicle during operation.

The fuel-adsorbing member is easily manufactured using a spongy material such as a foamed synthetic resin material which is elastic, so that it is resistant to vibrations and effective in suppressing noise. Alternatively, a fuel-adsorbing member made of a corrosion-resistant metal and having good heat conductivity is sufficiently durable with respect to returned acidic fuel, and can cool the adsorbed fuel.

In accordance with the second aspect of the invention, the partition in the fuel tank divides at least the area near the inlet port of the fuel pump and the area in front of the inlet port. Therefore, even if the vehicle is suddenly decelerated due to braking, a fuel level can be maintained substantially normal near the inlet port of the fuel tank, thereby protecting the engine against surge. Further, the fuel-adsorbing member supported on the partition can be easily arranged near the strainer.

When the fuel supply unit is applied to the motorcycle whose posture is extensively variable during operation, the engine thereof can be protected against surge according to the third aspect-of the invention. Therefore, the fuel supply unit is preferable for use with motorcycles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
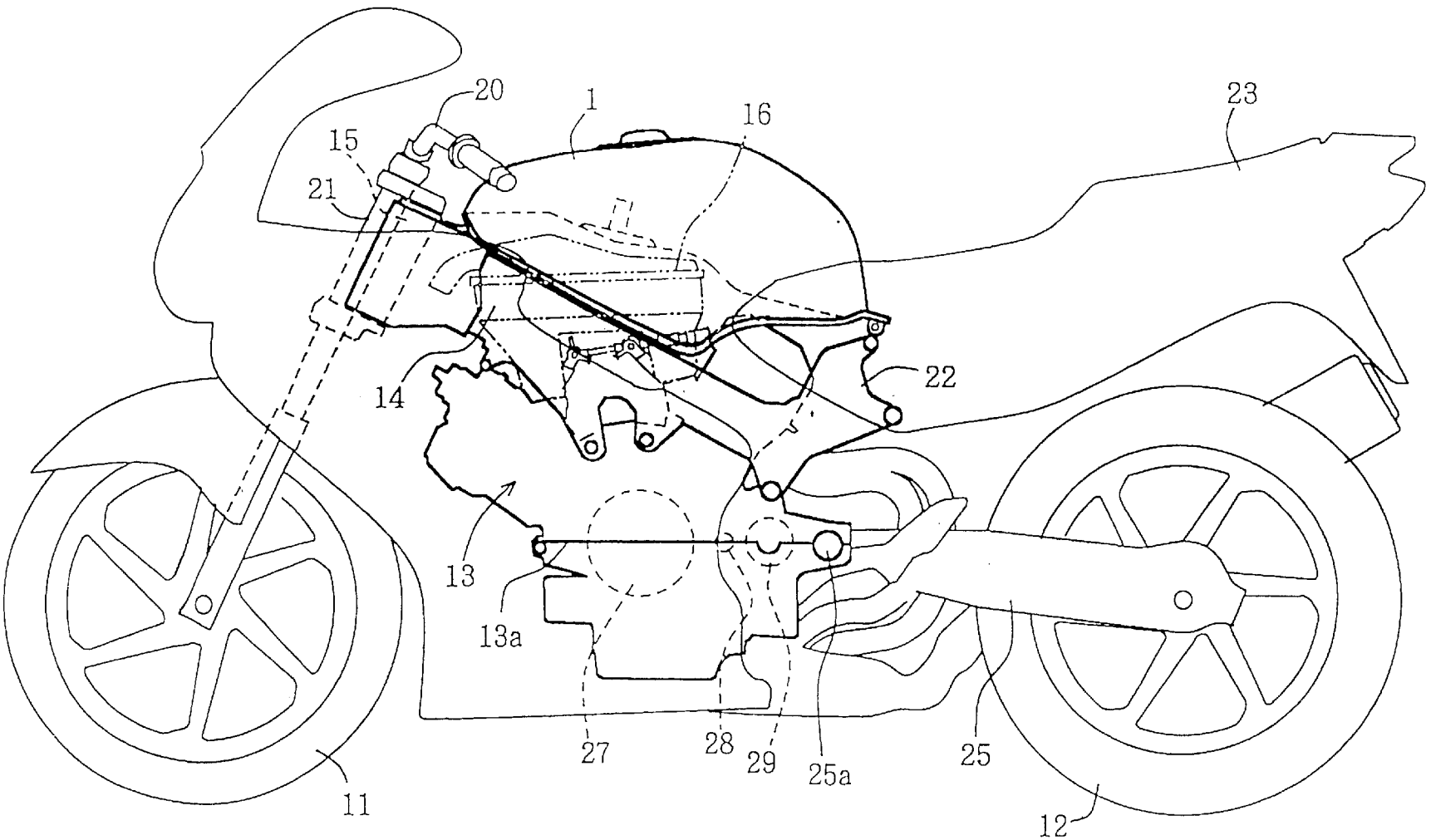
FIG. 2 is a side view of the motorcycle to which the invention is applied.

Referring to FIG. 2, the motorcycle 2 is provided with a V-type four-cycle engine 13 arranged between front and rear wheels 11 and 12. A main frame 14 suspending and supporting the engine 13 includes a pair of members extending from a head pipe 15 and over the engine 13 toward the rear of the motorcycle 2. A fuel tank 1 is supported on the main frame 14.

A bottom of the fuel tank 1 is partially raised to define a space thereunder. An air cleaner 16 housed in the foregoing space introduces air into respective cylinders of the engine 13, using a down-draft system. Fuel in the fuel tank 1 is simultaneously supplied to the cylinders via a throttle body 7 (shown in FIG. 1).

Figure 6:
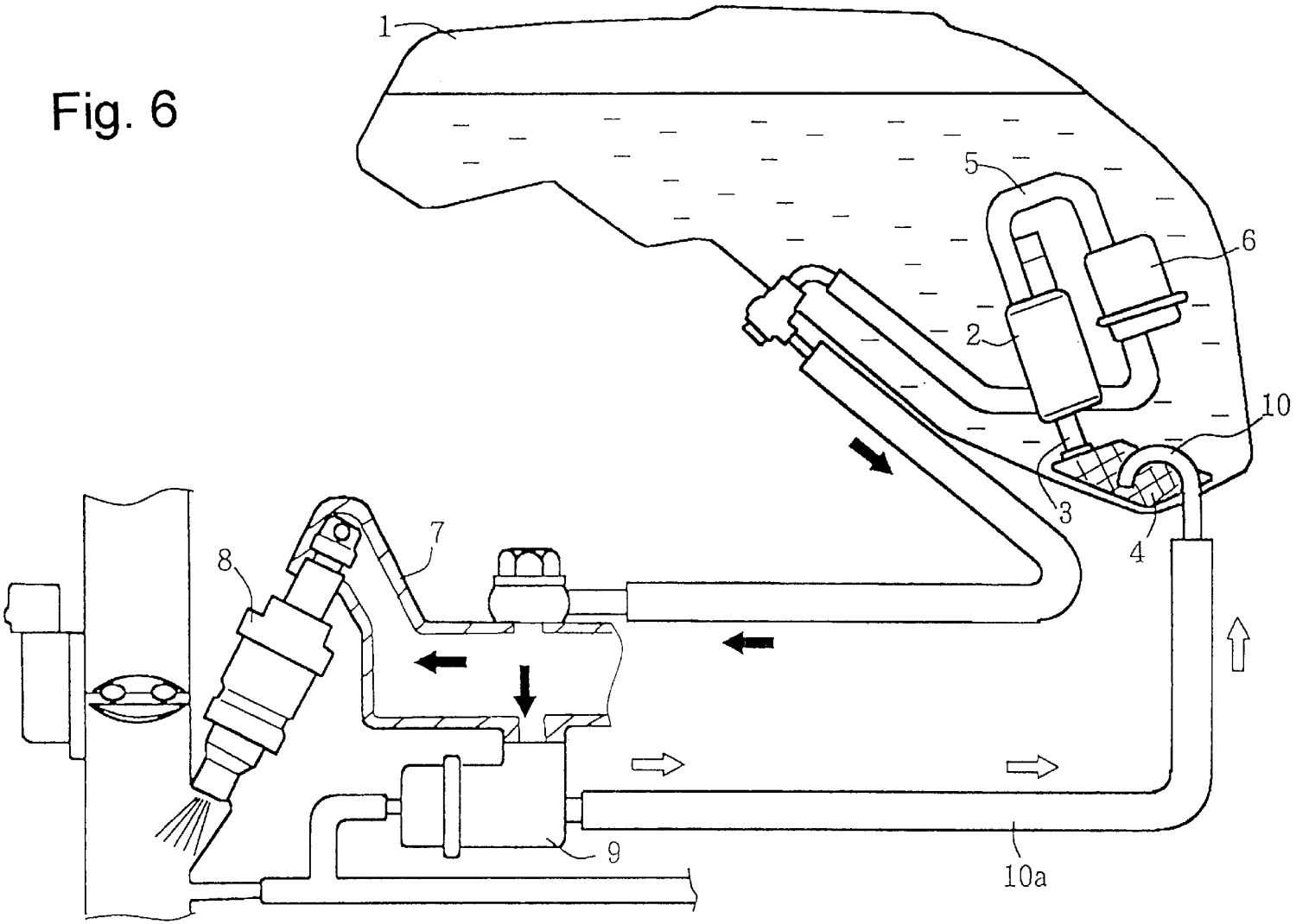
FIG. 6 is a schematic view of the fuel supply unit applied to a motorcycle in the related art.

Part of the fuel is brought back to the fuel tank 1 as returned fuel from the throttle body 7, as will be described later. The throttle body 7 is similar to that shown in FIG. 6, and its detailed structure and piping arrangement with the fuel tank 1 will not be described here.

In FIG. 2, a steering handle 20, a front fork 21, a seat rail support 22 extending obliquely and upwardly from the rear part of the main frame 14 towards the rear part of the motorcycle, a rear cowl 23, and rear swing arms 25 are operatively connected relative to each other. The rear swing arms 25 are directly attached at their front ends to a rear part of a casing 26 constituting the engine 13 so as to turn freely. The casing 26 is split into upper and lower parts. A crankshaft 27, a main shaft 28, an output sprocket shaft (countershaft) 29, a pivot shaft 25*a* and so on are arranged substantially straight on a split surface 13*a*.

Figure 1:
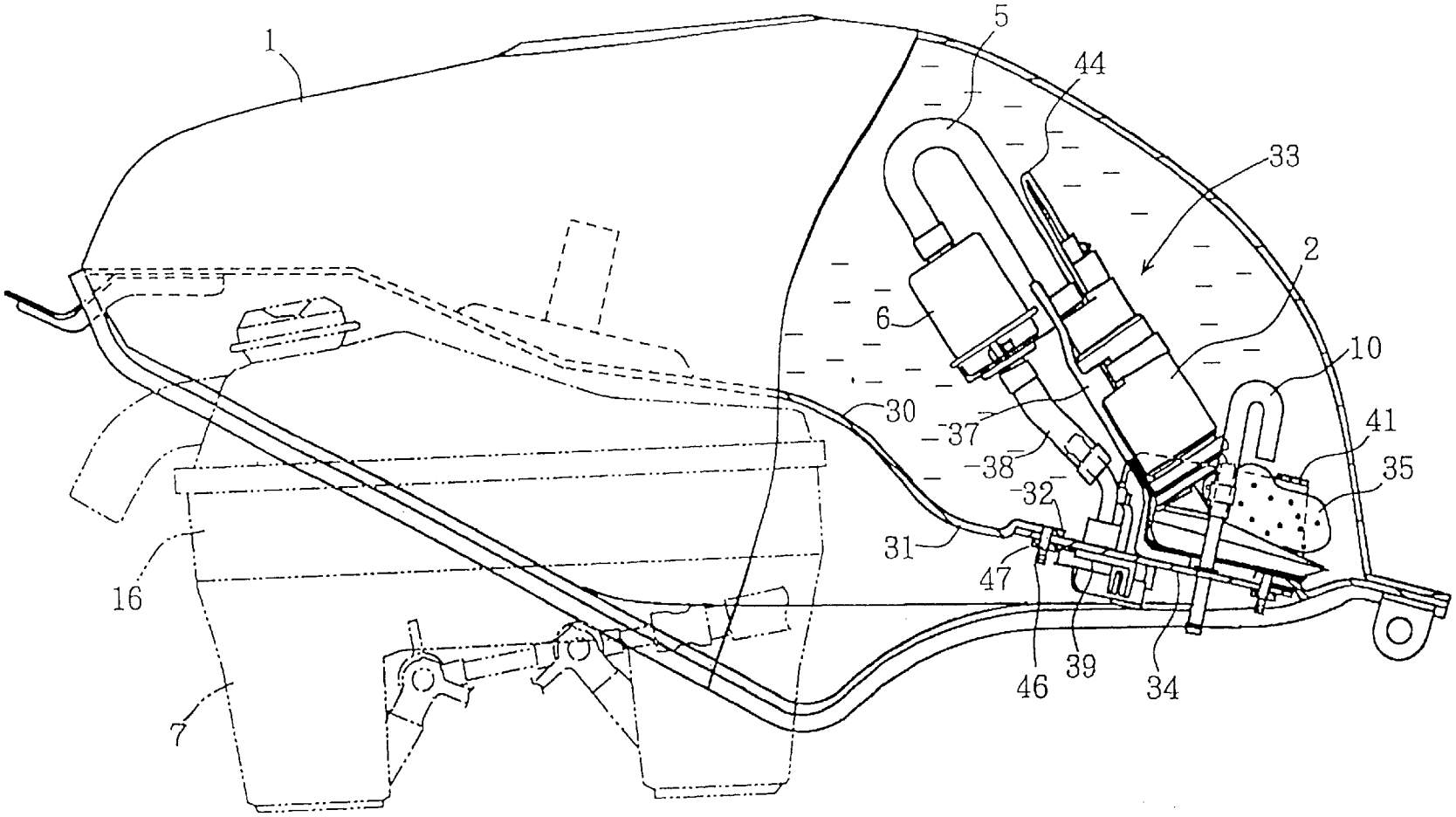
FIG. 1 is a cross-sectional view of the fuel supply unit according to an embodiment of the invention.

Referring to FIG. 1, the bottom 30 of the fuel tank 1 slopes moderately obliquely downwardly and rearwardly, and a rear part 31 of the bottom 30 is flat. A fuel pump assembly 33 is attached from a lower side to an opening 32 formed on the rear part 31, and is covered by a base plate 34.

Figure 3:
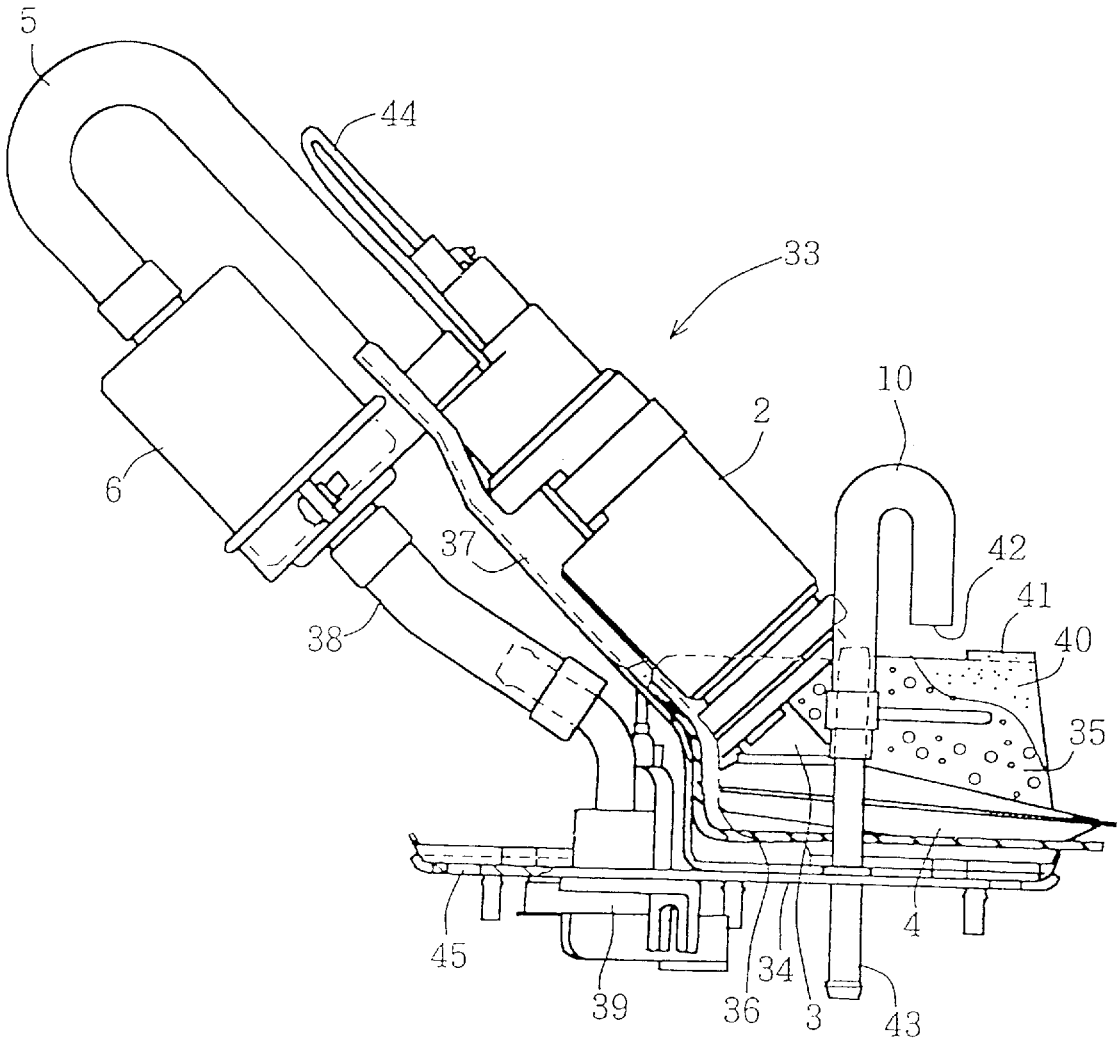
FIG. 3 is a side view of the fuel pump assembly.
Figure 4:
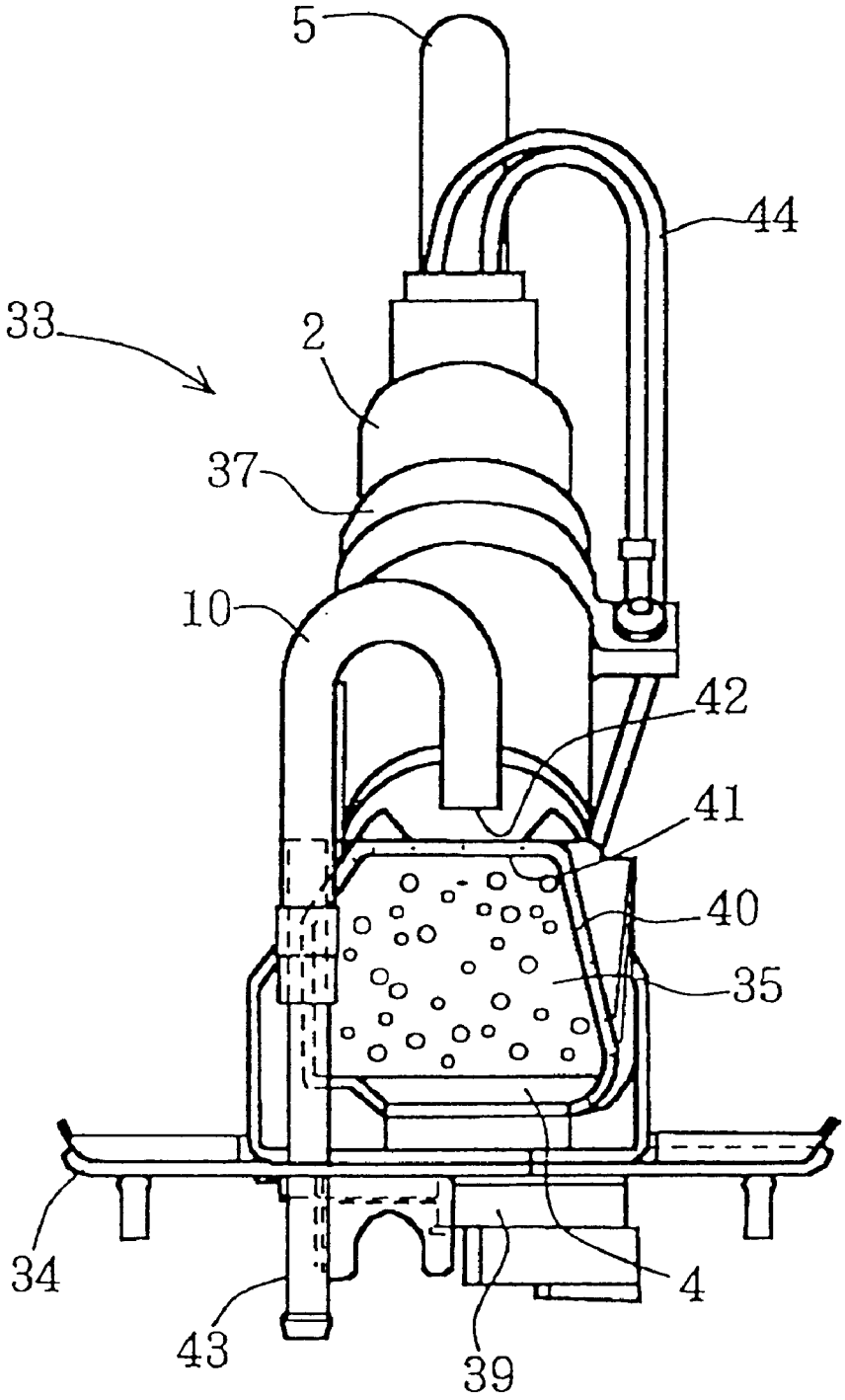
FIG. 4 is a rear view of the fuel pump assembly.
Figure 5:
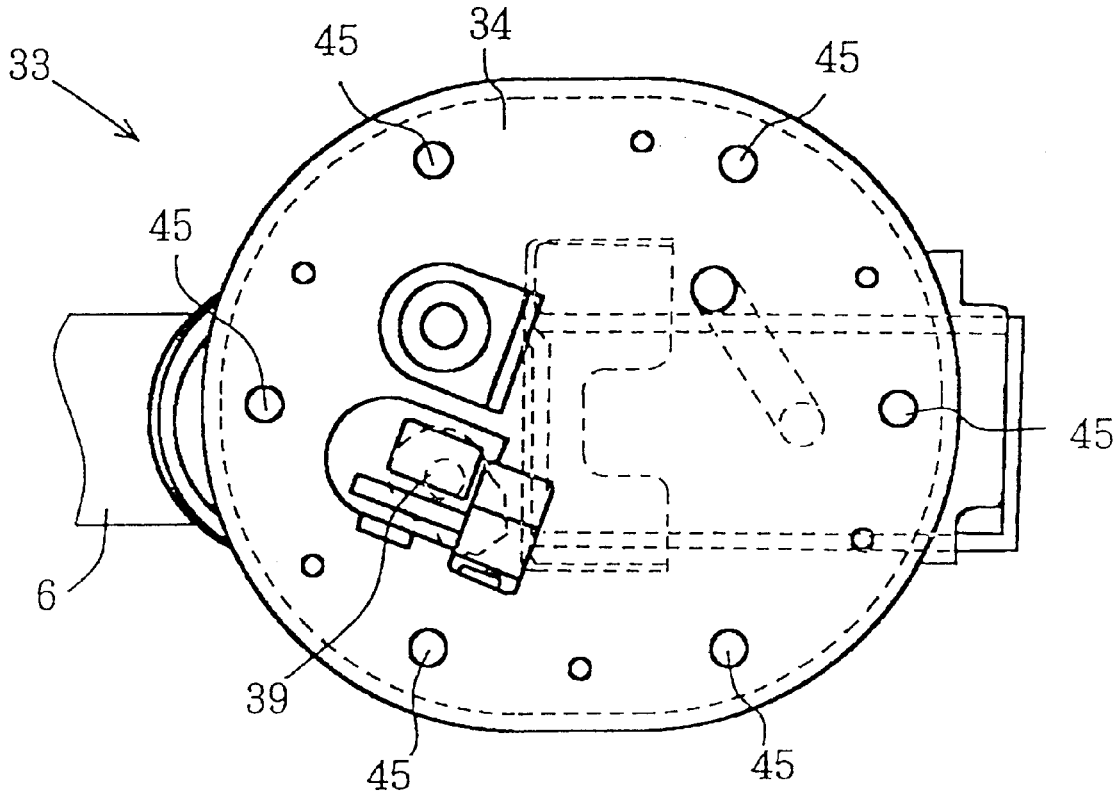
FIG. 5 is a bottom view of the fuel pump assembly.

As shown in FIGS. 3 to 5, the fuel pump assembly 33 includes the fuel pump 2, strainer 4, high-pressure fuel filter 6, fuel return pipe 10, fuel-adsorbing member 35, partition 36 and so on which are collectively and compactly disposed on the base plate 34.

The fuel pump 2 is supported by a stay 37 projecting from the center of the base plate 34 so as to be sloped obliquely forward. The high-pressure fuel filter 6 is disposed on the stay 37 at a position opposite to the fuel pump 2. A discharge port of the fuel pump 2 and an inlet port of the high-pressure fuel filter 6 are connected using a discharge pipe 5.

An outlet port of the high-pressure fuel filter 6 communicates via a pipe 38 which joins a pipe of a branch terminal 39 arranged on the base plate 34. High-pressure fuel is supplied to the throttle body 7 via the branch terminal 39.

The inlet port 3 of the fuel pump 2 is directly connected to the strainer 4, which includes a well-known mesh filter in order to remove foreign matter such as metal powders from the fuel.

A fuel-adsorbing member 35 of stainless steel is positioned on the strainer 4. Specifically, the fuel-adsorbing member 35 includes a stainless steel wire or strip coil which is wound to form a ring, or entwined to form a block, e.g., it is similar to a metallic scrubbing brush known as a household article.

The fuel-adsorbing member 35 is porous and elastic, i.e., it is full of minute pores compared with the meshes of the metal filter attached to the strainer 4, and has a total hollow area much larger than that of the mesh metal filter, which enables separation of the returned fuel into gases and liquid fuel.

The partition 36 is made of a relatively flexible material such as rubber, and is slightly larger than the strainer 4, but is relatively small compared with a partition constituting a conventional sub-tank. The partition 36 has a height which is sufficient to cover front parts of the inlet port 3, strainer 4, and fuel-adsorbing member 36.

The partition 35 extends upwardly from the base plate 34 in order to cover the lower side of the fuel pump 2, and the front, right and left sides of the strainer 4. Further, the right and left sides 40 of the partition 36 cover the right and left sides of the fuel-adsorbing member 35, and are open at the rear and top. The partition 36 is integral with a holding member 41 which extends across and above upper parts of the sides 40, and holds an upper part of the fuel-adsorbing member 35.

The upper part of the fuel-adsorbing member 35 is exposed except for an area held by the holding member 41. One end 42 of the fuel return pipe 10 in the shape of an inverted letter U extends downwardly to face the exposed area of the fuel-adsorbing member 35. The other end of the fuel return pipe 10 is connected to an upper end of the joint pipe 43 extending vertically through the base plate 34. The lower end of the joint pipe 43, not shown, is connected to the throttle body 7 via a connection hose (similar to the hose 10a shown in FIG. 6).

In FIGS. 1, 3 and 4, conductors 44 are provided for the fuel pump 2, together with a bolt hole 45 into which a bolt 46 projects downwardly from the peripheral surface of the base plate 43 and is fitted and fastened by a nut 47.

The operation of the embodiment will be described hereinafter. As shown in FIG. 1, the fuel housed in the fuel tank 1 is drawn up by the fuel pump 2, and is introduced to the throttle body 7 via the strainer and inlet port substantially at the bottom of the fuel tank 1, and via the high-pressure fuel filter 6.

The fuel returned and discharged onto the fuel-adsorbing member 35 via the tip 42 of the fuel return pipe 10 contains a relatively large amount of gases. However, the gases pass through the pores of the fuel-adsorbing member and are sifted from the returned fuel, so that the fuel remains adsorbed on the fuel-adsorbing member 35 as liquid fuel, and stays near the strainer 4.

Even when the fuel is reduced nearly to the lower limit in the fuel tank 1, the liquid fuel free from gases is supplied to the strainer from the fuel-adsorbing member 35. Therefore, the engine is effectively protected against a surge which is caused by gases contained in the fuel.

Further, the foregoing fuel remains adsorbed onto the fuel-adsorbing member 35, and is slow to move even when the posture of the vehicle is changed. Therefore, even if ripples are caused on the surface of the fuel around the fuel-adsorbing member 35, they can be stabilized by the fuel supplied from the fuel-adsorbing member 35.

In this embodiment, the fuel-adsorbing member 35 is a spongy filter made of stainless steel which is resistant to strong acidic fuel and is very durable. The stainless steel has a good heat conductivity so that the fuel-adsorbing member 35 can efficiently cool the fuel sticking thereon. This is very effective in separating gases from the returned hot fuel, in suppressing lowering of the fuel pressure, and improving fuel supplying efficiency.

The partition 36 separates the strainer 4 and the area in front of the strainer 4 to the predetermined height, which is effective in keeping the surface of the fuel from rippling near the strainer 4 even when the posture of the vehicle is varied.

Particularly, the fuel tends to move quickly forward when the motorcycle is suddenly braked. The partition 36 is effective in suppressing changes on the surface of the fuel near the strainer 4 which is present between the partition 36 and the rear wall of the fuel tank 1.

The partition 36 made of an elastic material such as rubber can suppress noise caused if it comes into contact with the fuel pump 2 or the strainer when the fuel tank 1 is vibrated by the vehicle during operation.

The partition 36 reliably supports the fuel-adsorbing member 35 which is elastic and is easily deformed, so that it is possible to efficiently prevent noise caused when these members come into contact with each other.

Further, the partition 36 is positioned near the fuel pump assembly 33 which is independent from the bottom 30 of the fuel tank 1. Therefore, it is not necessary to press-form the partition 36 into a complicated shape, and the fuel pump assembly 33 can be supported on the flat portion 31 of the bottom 30. The flat portion 31 is easy to shape, which means that the fuel tank 1 can be easily formed.

It should be noted that the present invention is not limited to the illustrative embodiment which has been described and represented above, but can encompass all variants. For example, the fuel-adsorbing member may be realized using felt-like metal wool made by weaving and shrinking minute metal fibers as thin as hairs, or using a woven or non-woven cloth of metal fibers, or using a mesh obtained by knitting the metal fibers. Further, a synthetic resin sponge such as foamed polyurethane or natural sponge or rubber sponge may be usable as the fuel-adsorbing member.

Alternatively, fuel may be supplied on the basis of a natural air intake system using a carburetor in place of fuel injection. Further, the fuel pump may be disposed outside the fuel tank instead of the in-tank system employed in the embodiment. In addition, the fuel supply unit is applicable to various types of vehicles such as four-wheel vehicles as well as motorcycles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel supply unit for a vehicle, comprising:

a fuel tank;

a fuel pump for providing a fuel supply system of the vehicle with fuel introduced from said fuel tank via a strainer disposed therein;

a fuel return pipe for returning surplus fuel from said fuel supply system to said fuel tank; and a spongy fuel-adsorbing member positioned on at least an upper surface of said strainer and being disposed between said strainer and a tip of said fuel return pipe, said spongy fuel-adsorbing member being made of a corrosion-resistant metal, porous and includes a plurality of minute pores for enabling separation of the return fuel into gases and liquid fuel and for protecting against a surge in the fuel caused by gases in the fuel, wherein fuel adsorbed by said spongy fuel-adsorbing member is retained to slowly move to said strainer for stabilizing ripples caused on the surface of the fuel around the fuel-adsorbing member and for stabilizing fuel supplied to said strainer.

2. The fuel supply unit according to claim 1, wherein a partition is disposed in said fuel tank adjacent to a lower surface of said strainer and includes side members for covering predefined areas of side portions and a top portion of said spongy fuel-adsorbing member in order to separate at least an area near an inlet port of said fuel pump and an area in front of said inlet port.

3. The fuel supply unit according to claim 2, wherein said fuel-adsorbing member is supported by said partition.

4. The fuel supply unit according to claim 3, wherein the fuel supply unit is designed for a motorcycle.

5. The fuel supply unit according to claim 1, wherein the fuel supply unit is designed for a motorcycle.

6. The fuel supply unit according to claim 3, wherein the fuel supply unit is designed for a motorcycle.

7. A fuel supply unit for a vehicle, comprising:

a fuel tank;

a strainer having at least an upper surface and a lower surface and being disposed within said fuel tank;

a fuel pump for pumping fuel contained within the fuel tank, the fuel being introduced to said fuel pump from said fuel tank via said strainer disposed therein;

a fuel return pipe having a first end and a second end for returning surplus fuel from said fuel supply system to said fuel tank;

a spongy fuel-adsorbing member positioned on at least said upper surface of said strainer and being disposed between said strainer and the second end of said fuel return pipe, said spongy fuel-adsorbing member being porous and elastic and includes a plurality of minute pores for enabling separation of the return fuel into gases and liquid fuel and for protecting against a surge in the fuel caused by gases in the fuel, fuel being adsorbed by said spongy fuel-adsorbing member is retained to slowly move to said strainer for stabilizing ripples caused on the surface of the fuel around the fuel-adsorbing member and for stabilizing fuel supplied to said strainer; and a partition disposed in said fuel tank adjacent to said lower surface of said strainer and including side members for covering predefined areas of side portions and a top portion of said spongy fuel-adsorbing member.

8. The fuel supply unit according to claim 7, wherein said fuel-adsorbing member is made of a corrosion-resistant metal.

9. The fuel supply unit according to claim 7, wherein said partition is constructed of a relatively flexible material.

10. The fuel supply unit according to claim 9, wherein said fuel-adsorbing member is supported by said partition.

11. The fuel supply unit according to claim 7, wherein the fuel supply unit is designed for a motorcycle.

12. The fuel supply unit according to claim 8, wherein the fuel supply unit is designed for a motorcycle.

13. The fuel supply unit according to claim 9, wherein the fuel supply unit is designed for a motorcycle.

14. The fuel supply unit according to claim 10, wherein the fuel supply unit is designed for a motorcycle.

15. The fuel supply unit according to claim 7, wherein said spongy fuel-adsorbing member is constructed of stainless steel for effectively cooling fuel supplied thereto.

16. A fuel supply unit for a vehicle, comprising:

a fuel tank;

a fuel pump for providing a fuel supply system of the vehicle with fuel introduced from said fuel tank via a strainer disposed therein;

a fuel return pipe for returning surplus fuel from said fuel supply system to said fuel tank; and a spongy fuel-adsorbing member positioned on at least an upper surface of said strainer and being disposed between said strainer and a tip of said fuel return pipe, said spongy fuel-adsorbing member being made of a corrosion-resistant material, porous and includes a plurality of minute pores for enabling separation of the return fuel into gases and liquid fuel and for protecting against a surge in the fuel caused by gases in the fuel, wherein fuel adsorbed by said spongy fuel-adsorbing member is retained to slowly move to said strainer for stabilizing ripples caused on the surface of the fuel around the fuel-adsorbing member and for stabilizing fuel supplied to said strainer, whereby fuel passing to said fuel pump first passes through said spongy fuel-adsorbing member and into said strainer.

17. The fuel supply unit according to claim 16, wherein the fuel supply unit is designed for a motorcycle.

18. The fuel supply unit according to claim 16, wherein said spongy fuel-adsorbing member is constructed of stainless steel for effectively cooling fuel supplied thereto.

19. The fuel supply unit according to claim 16, wherein said spongy fuel-adsorbing member is constructed of a synthetic resin.

20. The fuel supply unit according to claim 16, wherein said spongy fuel-adsorbing member is constructed of rubber or natural sponge.

* * * * *